US008464868B2

(12) United States Patent
Kruger et al.

(10) Patent No.: US 8,464,868 B2
(45) Date of Patent: Jun. 18, 2013

(54) TOOTHBRUSH HOLDER

(76) Inventors: Gary Iver Kruger, Akron, OH (US); Susan Kruger, Akron, OH (US)

( * ) Notice: Subject to any disclaimer, the term of this patent is extended or adjusted under 35 U.S.C. 154(b) by 288 days.

(21) Appl. No.: 11/984,449

(22) Filed: Nov. 19, 2007

(65) Prior Publication Data

US 2009/0127214 A1 May 21, 2009

(51) Int. Cl.
*B65D 85/20* (2006.01)
*A47B 81/02* (2006.01)
*A47K 1/09* (2006.01)

(52) U.S. Cl.
USPC ..... 206/362.1; 206/362; 206/361; 211/65; 248/110

(58) Field of Classification Search
USPC ..... 206/362, 209, 361, 362.1, 362.2, 206/362.3, 564, 565, 561, 1.7–1.9; 211/65; 248/110, 37.3, 108, 109, 111, 113; D6/534, D6/528
See application file for complete search history.

(56) References Cited

U.S. PATENT DOCUMENTS

| | | | | | |
|---|---|---|---|---|---|
| 72,009 | A | * | 12/1867 | Foster | 248/37.3 |
| 200,083 | A | * | 2/1878 | Oviatt | 131/240.1 |
| 1,584,206 | A | | 5/1926 | Balin | |
| D167,891 | S | * | 10/1952 | Hallward | D6/534 |
| 2,629,499 | A | * | 2/1953 | Welshenbach | 211/70.1 |
| 2,664,005 | A | * | 12/1953 | Kosinski | 211/70.1 |
| 3,366,232 | A | * | 1/1968 | Elfstrom et al. | 206/315.11 |
| 3,489,268 | A | * | 1/1970 | Meierhoefer | 206/366 |
| 3,837,477 | A | * | 9/1974 | Boudreau | 206/376 |
| D248,907 | S | * | 8/1978 | Yang | D6/534 |
| D253,736 | S | | 12/1979 | Guarino | |
| D273,257 | S | | 4/1984 | Barrera | |
| D277,814 | S | | 3/1985 | Thompson | |
| 4,573,569 | A | * | 3/1986 | Parker | 206/1.7 |
| D291,268 | S | * | 8/1987 | Stephenson | D6/534 |
| D295,234 | S | * | 4/1988 | Luhrsen et al. | D4/199 |
| 4,967,914 | A | * | 11/1990 | Keeton | 211/70.7 |
| 4,995,515 | A | * | 2/1991 | Smith | 211/65 |
| 5,090,564 | A | * | 2/1992 | Chimienti | 206/365 |
| D327,194 | S | | 6/1992 | Merkel | |
| D327,195 | S | | 6/1992 | Murphy | |
| D327,801 | S | * | 7/1992 | Lee | D6/553 |
| 5,131,542 | A | * | 7/1992 | Stenstrom | 206/476 |
| D347,280 | S | * | 5/1994 | Herrington et al. | D24/130 |
| D354,988 | S | * | 1/1995 | Garza | D19/85 |
| 5,411,141 | A | * | 5/1995 | Bounds | 206/553 |
| D370,338 | S | * | 6/1996 | Quist | D3/205 |
| 5,681,539 | A | * | 10/1997 | Riley | 422/300 |
| 5,759,502 | A | * | 6/1998 | Spencer et al. | 422/300 |
| 5,769,245 | A | * | 6/1998 | Butler | 211/65 |
| D418,706 | S | | 1/2000 | Robishaw | |
| 6,119,854 | A | | 9/2000 | Prentice | |
| 6,343,700 | B1 | | 2/2002 | Slendebroek | |
| D481,572 | S | | 11/2003 | Dretzka | |
| 6,758,446 | B2 | | 7/2004 | Bjornrud | |
| D502,623 | S | | 3/2005 | Minard | |
| D504,587 | S | * | 5/2005 | Root | D6/534 |
| 2003/0034315 | A1 | * | 2/2003 | Tayebi | 211/65 |

FOREIGN PATENT DOCUMENTS

| | | |
|---|---|---|
| DE | 202005021046 | 4/2007 |
| GB | 125916 | 5/1919 |
| GB | 2232581 A | 12/1990 |

* cited by examiner

*Primary Examiner* — Steven A. Reynolds

(57) ABSTRACT

A cleaning article holder is provided which is capable of fitting within a cabinet drawer and supports in a nonvertical position one or more cleaning articles having a neck that extends between a cleaning head and an elongated handle.

17 Claims, 10 Drawing Sheets

TOOTHBRUSH HOLDER

RELATED APPLICATIONS

There are no previously filed, nor any co-pending applications, anywhere in the world.

BACKGROUND OF THE INVENTION

1. Field of Invention

The invention relates to toothbrush holders and, more particularly, to a toothbrush holder that will hold one or more toothbrushes in an incline, or in the alternate a horizontal, position, instead of the vertical position. Said invention can be used to hold any cleaning article having a neck that extends between a cleaning head and an elongated handle, and the invention is intended to cover all such uses of the holder.

2. Description of the Related Art

Toothbrush holders have been used for many years to hold toothbrushes in the vertical position. Toothbrush holders are being marketed in the consumer market today that are designed to hold toothbrushes in a vertical position. These vertical toothbrush holders are being marketed in various ornamental designs. Examples of vertical toothbrush holders are shown in U.S. Pat. Nos. Des. 327,195, D481,572 S, and Des. 418,706. Vertical toothbrush holders commonly consist of a vertical stem mounted on a base with a disc mounted on top of the stem with holes in it to hold the toothbrush or toothbrushes in a vertical position such as shown in Pat. No. Des. 418,706. The foregoing examples of vertical toothbrush holders are not covered and do not shield the toothbrushes held in them from bacteria that are released into the air in the bathroom when the toilet in the bathroom is flushed. These open vertical toothbrush holders are generally placed on a counter in the bathroom or on a shelf in the bathroom with the result that the toothbrushes that are held in them are exposed to bacteria that are released into the air in the bathroom when the toilet in the bathroom is flushed. This permits bacteria that are released into the air in the bathroom when the toilet in the bathroom is flushed to contaminate the toothbrushes held in such open vertical toothbrush holders. Vertical toothbrush holders generally do not fit into the drawers that are typically built into a cabinet in the bathroom where they could be shielded from the bacteria that are released into the air in the bathroom when the toilet in the bathroom is flushed.

The toothbrush holder in U.S. Pat. Des. 277,814 is an ornamental vertical design designed for use on a counter top. This toothbrush holder is designed to place the handle of the toothbrush in a hole in the holder with the toothbrushes protruding vertically up and out of the toothbrush holder. The design and structure of this toothbrush holder are such that the toothbrush holder would not fit in a typical drawer in a bathroom with a toothbrush placed in it. Since the handle of the toothbrush is placed in a hole in the toothbrush holder, the fit of the handle in the hole would have to be loose to accommodate different sizes of toothbrushes. Also, there is no support for the head of the toothbrush. Therefore, this toothbrush holder can not hold a toothbrush in place in a stable manner. Since this toothbrush holder is not covered and is designed for use on a counter top, a toothbrush placed in this holder would be exposed to bacteria that are released into the air in the bathroom when the toilet in the bathroom is flushed.

Some vertical toothbrush holders have been designed with covers that partially shield the toothbrushes that are held in them from bacteria that are released into the air in the bathroom when the toilet in the bathroom is flushed, with the handles of the toothbrushes extending down outside of said covers. Examples of such vertical toothbrush holders are shown in U.S. Pat. Nos. D502,623 S and 5,769,245. The toothbrush holders shown in these two patents are not totally enclosed, and have no reservoirs to collect liquid that may drip from the toothbrushes that are placed in them.

Some vertical toothbrush holders have been designed that are totally enclosed. An example of a totally enclosed vertical toothbrush holder is shown in U.S. Pat. No. 6,119,854. The drawback of this particular totally enclosed holder is that the toothbrush lays against the bottom of the holder where it touches the residue from the liquid that daily drains off the toothbrushes placed in it. In addition, the drawback of all totally enclosed toothbrush holders is that the liquid does not evaporate as quickly from the head of the toothbrush, and the enclosed holder provides a potential breeding ground for bacteria.

Some horizontal toothbrush holders have been designed. Horizontal toothbrush holders are set forth in U.S. Pat. Nos. Des. 291,268, Des. 295,234, Des. 370,338, and 6,343,700 B1. The horizontal toothbrush holders in U.S. Pat. Nos. Des. 291,268, Des. 295,234, and Des. 370,338 all have covers. These toothbrush holders, therefore, have the drawback that the liquid does not evaporate as quickly from the head of the toothbrush and the covered holder provides a potential breeding ground for bacteria. The horizontal toothbrush holder in U.S. Pat. No. 6,343,700 B1 is an open container consisting of a horizontal rectangular tray having opposing sides, opposing ends, and a bottom. The distance between the sides of the toothbrush holder are dimensioned to prevent placement of the toothbrush holder on its side, and, based on that, this patent states that this design prevents potentially contaminating contact between the bristles of the toothbrush and the interior of the toothbrush holder. The drawback of this toothbrush holder is that the back of the head of the toothbrush still lies on the bottom of this toothbrush holder and this toothbrush holder does not prevent contaminating contact between the back of the head of the toothbrush and the liquid and residue that builds up on the bottom of this toothbrush holder during continued use, and, therefore, each time the user uses the toothbrush that is placed in it, any contamination picked up by the back of the head of the toothbrush while laying on the bottom of this toothbrush holder is placed into the mouth of the user each time the user lifts the toothbrush from it after prior use.

Some toothbrush holders have been designed that hold a toothbrush in a incline position rather than a vertical or horizontal position. The toothbrush holders in U.S. Pat. No. 1,584,206 issued in 1926, Des. 248,907 issued in 1978, Des. 253,736 issued in 1979, Des. 273,257 issued in 1984, Des. 327,194 issued in 1992, U.S. Pat. No. 6,758,446 B2 issued in 2004, and D504,587 S issued in 2005 all hold the toothbrush in an incline position.

The toothbrush holder in U.S. Pat. No. 1,584,206 issued in 1926 is a totally enclosed toothbrush holder and, therefore, suffers from the drawback of all totally enclosed toothbrush holders, namely, the liquid does not evaporate as quickly from the head of the toothbrush and the enclosed holder provides a potential breeding ground for bacteria. In addition, this toothbrush holder was designed to hold toothbrushes that had a hole in the handle of the toothbrush with the toothbrush being placed on a peg built into the holder to hold the toothbrush in the incline position with the head of the toothbrush in the lower incline position. Further, the design of this toothbrush holder keeps the back of the head of the toothbrush in contact with the body of the toothbrush holder and this toothbrush holder, therefore, does not prevent contaminating contact between the back of the head of the toothbrush and the liquid that runs onto, and the residue that builds up on, the body of this toothbrush holder during continued use. Therefore, each time the user uses the toothbrush that is placed in it, contamination that is picked up by the back of the head of the toothbrush while laying against the body of this toothbrush holder is placed into the mouth of the user each time the user lifts the toothbrush from it after prior use.

The incline toothbrush holder in U.S. Pat. Des. 248,907 issued in 1978 is purely an ornamental design that is designed to be placed on a counter top and, based on its design and structure, would not fit in a typical drawer in a bathroom. Toothbrushes placed on this toothbrush holder would thus be exposed to bacteria that are released into the air in the bathroom when the toilet in the bathroom is flushed. The design of the upper slots in which the neck of the toothbrush is placed does not provide a stable resting place for toothbrushes of varying designs.

The incline toothbrush holder in U.S. Pat. Des. 253,736 issued in 1979 is likewise an ornamental design. Based on its design and structure and the design of its stand, this toothbrush holder would likewise not fit in a typical drawer in a bathroom. A toothbrush placed in this holder would, therefore, be exposed to bacteria that are released into air in the bathroom when the toilet in the bathroom is flushed. In addition, the design of this toothbrush holder does not hold the toothbrush in a stable position.

The toothbrush holder in U.S. Pat. Des. 273,257 issued in 1984 is an ornamental design for a combined toothpaste dispenser and toothbrush holder. The drawback of this toothbrush holder is that the back of the head of the toothbrush that is placed in it is in contact with the body of the toothbrush holder and this toothbrush holder, therefore, does not prevent contaminating contact between the back of the head of the toothbrush and the liquid that runs onto, and the residue that builds up on, the body of this toothbrush holder during continued use. Therefore, each time the user uses the toothbrush that is placed in it, contamination that is picked up by the back of the head of the toothbrush while laying against the body of this toothbrush holder is placed into the mouth of the user each time the user lifts the toothbrush from it after prior use. In addition, this toothbrush holder is designed to place the head of the toothbrush at the lower end of the incline holder, not at the higher, upper end of the incline holder. This allows the head of the toothbrush to rest at the end of the holder where the liquid from the toothbrush drains to, and to come in contact with the liquid that drains there and the residue that accumulates in that area. Even if the toothbrush was placed into this holder with the head of toothbrush in the opposite direction, a position for which the holder was not designed, the back of the head of the toothbrush still comes into contaminating contact with the body of the holder. In addition, the design of this toothbrush holder does not hold the toothbrush placed in it in a stable position.

The toothbrush holder in U.S. Pat. Des. 327,194 issued in 1992 is an ornamental design designed for use on a counter top. The design and structure of this toothbrush holder are such that the toothbrush holder would not fit in a typical drawer in a bathroom with toothbrushes placed in it. Since this toothbrush holder is designed for use on a counter top, a toothbrush placed in this holder would be exposed to bacteria that are released into the air in the bathroom when the toilet in the bathroom is flushed. This toothbrush holder is designed to place the handle of the toothbrush in a hole at the bottom of the base of the holder that would have to be big enough to accommodate different sizes of toothbrushes. There is no support directly at the head of the toothbrush. Therefore, this toothbrush holder can not hold a toothbrush in a stable manner. In addition, any liquid on the handle of the toothbrush after use could run down the handle of the toothbrush and into the portion of the toothbrush holder that the handle of the tooth brush rests against.

The toothbrush holder in U.S. Pat. No. 6,758,446 B2 issued in 2004 is a portable toothbrush holding device for holding a toothbrush having a generally planar shape with at least one linear edge for resting on a planar surface such as a counter or lavatory basin. The toothbrush holder comprises one or more holes there through for the passage of a toothbrush handle. The distal end of the toothbrush handle rests upon the surface such as a counter or lavatory basin, while the bristle end of the toothbrush is elevated of the counter surface due to the propping action of the toothbrush holder. The abstract of this patent does not contemplate this toothbrush holder being used in a drawer in a bathroom. However, even if this toothbrush holder were placed in a drawer in a bathroom it would be inconvenient for the user to use this toothbrush holder because the user has to either pick the holder up or tilt it, insert the toothbrush handle though the hole in the holder, and then position the handle of the toothbrush after it is placed through the hole. There is no reservoir to collect the liquid that drains off of the head of the toothbrush and if this holder was kept in a drawer in the bathroom with toothbrushes placed in it, the liquid from the toothbrush would drain directly onto the bottom of the drawer creating an unsanitary situation. In addition, the distal end of the toothbrush handle would rest against the bottom of the drawer where it would come in contact with any contaminants that collect on the bottom of the drawer.

The toothbrush holder in U.S. Pat. D504,587 S issued in 2005 is an ornamental design. Since it is an ornamental design it is designed for use on a counter top where a toothbrush placed in it would be exposed to bacteria that are released into the air in the bathroom when the toilet in the bathroom is flushed. However, even if this toothbrush holder were placed in a drawer, the toothbrush holder can not hold a toothbrush in a stable manner because the slots or indents on which the neck of the toothbrush are placed are flat and wide and the necks of many toothbrushes on the market today are rounded. This holder supports only the neck of the toothbrush that is placed in it. The distal end of the toothbrush rests on the bottom of the drawer and could easily slide from side to side. For these reasons, a toothbrush placed on this holder would not be held in a stable position. In addition, the distal end of the toothbrush handle would rest upon the bottom of the drawer where it would come into contact with any contaminants that collect on the bottom of the drawer.

Toothbrush holders that are designed to sit on counters or be mounted on walls all suffer from the same drawback that afflicts all toothbrush holders that sit on counters or are mounted on walls, namely, toothbrush holders and toothbrushes detract from the appearance of a bathroom and toothbrush holders and toothbrushes are, therefore, better kept out of sight.

The objectives of the present invention are, among other things, to provide a toothbrush holder without a cover which allows toothbrushes to be quickly, easily, and conveniently placed on the holder and held in a closed drawer in a raised position, with stable support for both the neck and the handle of the toothbrush, to allow liquid to drain off or evaporate from the toothbrushes while resting on toothbrush holder inside the closed drawer, and, by virtue of having been placed in a closed drawer, to help shield the toothbrushes resting on the toothbrush holder from bacteria that are released into the air in the bathroom when the toilet in the bathroom is flushed.

No known prior art discloses a toothbrush holder designed to meet all of these objectives.

SUMMARY OF THE INVENTION

Briefly described, the present invention comprises a toothbrush holder whereby toothbrushes are quickly, easily, and conveniently placed in a raised and stable position on the holder inside a drawer in a bathroom to help shield the toothbrushes from bacteria that are released into the air in the bathroom when the toilet in the bathroom is flushed and which holds the toothbrushes with the bristles of the brush exposed to the air inside the drawer for drying.

There has thus been outlined, rather broadly, important features of the invention in order that the detailed description thereof that follows may be better understood, and in order that the present contribution to the art may be better appreciated. There are additional features of the invention that will be described hereinafter and which also form the subject matter of the claims appended hereto.

An objective of the invention is to provide a toothbrush holder that will hold one or more toothbrushes in an incline, or in the alternate a horizontal, position instead of the vertical position to enable the toothbrush holder to be placed in a closed typical drawer in a bathroom. A further objective of the invention is to provide an open top toothbrush holder that will allow one or more toothbrushes to be held in an incline, or in the alternate a horizontal, position in a closed typical drawer in a bathroom, to allow liquid to drain off and/or evaporate from the toothbrush(s) while laying on the toothbrush holder inside the closed drawer, and, by virtue of having been placed in a closed drawer, to help shield the toothbrush(s) resting on the toothbrush holder from bacteria that are released into the air in the bathroom when the toilet in the bathroom is flushed. A further objective of the invention is to provide an incline, or in the alternate a horizontal, toothbrush holder that has a reservoir or receptacle to catch liquids that drop from the head of the toothbrush that is placed on it. A further objective of the invention is to provide an incline, or in the alternate a horizontal, toothbrush holder that provides stable support for both the neck and the handle of toothbrushes placed on it and on which a toothbrush can be quickly, easily, and conveniently placed. A further objective of the invention is to provide an incline, or in the alternate a horizontal, toothbrush holder to hold the head of the toothbrush(s) placed thereon in a raised position such that the head of the toothbrush does not come into contaminating contact with the body of the toothbrush holder. A further objective of the invention is to provide an incline, or in the alternate a horizontal, toothbrush holder that provides the convenience of: (a) being able to conveniently store the toothbrush holder in a typical drawer in a bathroom with convenient, quick, and easy access to the open top incline, or in the alternate a open top horizontal, toothbrush holder and the brush(s) resting thereon by simply opening said drawer, and (b) being able to place the toothbrush(s) on, and remove the toothbrush(s) from, the incline, or in the alternative a horizontal, toothbrush holder stored in said drawer without having to open or remove a cover or lid on the toothbrush holder. A further objective of the invention is to provide a toothbrush holder that is easy to clean. A further objective of the invention is to provide a toothbrush holder that is easy to manufacture.

These objectives and advantages are obtained by the open top incline, or in the alternate a horizontal, construction of the invention, the general nature of which may be stated as being a toothbrush holder designed either: (a) to hold one or more toothbrushes in an incline position instead of a vertical or horizontal position with stable support for both the neck and the handle of the toothbrushes, and with a reservoir or receptacle, or in the alternate without a reservoir or receptacle, and formed of plastic, metal, or other material; or (b) in the alternate design to hold one or more toothbrushes in a horizontal position instead of a vertical or incline position with stable support for both the neck and the handle of the toothbrushes, and with a reservoir or receptacle, or in the alternate without a reservoir or receptacle, and formed of plastic, metal, or other material.

Still further objects and advantages will become apparent from a consideration of the ensuing description and drawings.

Further areas of applicability of the present invention will become apparent from the detailed description provided hereafter. While the foregoing discussion discusses the invention with respect to toothbrushes being held on the holder, it is apparent that the holder can be used to hold any cleaning article having a neck that extends between a cleaning head and an elongated handle, and the invention is intended to cover all such uses of the holder.

Without in any way limiting the scope of the invention or the claims appended hereto, the following holders fall within the scope of the invention:

a) A holder for one or more toothbrushes having a neck that extends between a cleaning head and an elongated handle, the holder comprising a base, and first and second spaced apart support members supported by said base, wherein said first support member includes a first indent, and said second support member includes a second indent, said indents aligned and vertically offset from one another, such that said first indent is comprised of two oblique rectilinear support surfaces, wherein said rectilinear support surfaces are adapted to support the neck of the toothbrush, and said second indent is adapted to support the handle, and wherein said support members and indents are configured so as to support the toothbrush in an inclined orientation on the holder.

b) A holder for one or more toothbrushes having a neck that extends between a cleaning head and an elongated handle, the holder comprising a base, and first and second spaced apart support members supported by said base, wherein said first support member includes a first indent, and said second support member includes a second indent, said indents aligned and vertically offset from one another, wherein said first indent is adapted to support the neck of the toothbrush, and said second indent is adapted to support the handle, wherein said support members and indents are configured so as to support the toothbrush in an inclined orientation on the holder, and wherein the holder is configured such that the second support member is attached proximate one end of said base such that the handle of the toothbrush partially extends beyond said base of the holder when placed thereon.

c) A holder for one or more toothbrushes having a neck that extends between a cleaning head and an elongated handle, the holder comprising a base, and first and second spaced apart support members supported by said base, wherein said first support member includes a first indent, and said second support member includes a second indent, said indents substantially horizontally aligned with one another, such that said first indent is comprised of two oblique rectilinear support surfaces, wherein said rectilinear support surfaces are adapted to support the neck of the toothbrush, and said second indent is adapted to support the handle, and wherein said support members and indents are configured so as to support the toothbrush in a substantially horizontal orientation on the holder.

d) A holder for one or more toothbrushes having a neck that extends between a cleaning head and an elongated handle, the holder comprising: a base; and first and second spaced apart support members supported by said base, wherein said first support member includes a first indent adapted to support the neck of the toothbrush, and said second support member includes a second indent adapted to support the handle of the toothbrush, said indents substantially horizontally aligned with one another, wherein said support members and indents are configured so as to support the toothbrush in a substantially horizontal orientation on the holder, and wherein the holder is configured such that the second support member is attached proximate one end of said base such that the handle of the toothbrush partially extends beyond said base of the holder when placed thereon.

It should be understood that the detailed description and specific examples, while indicating the preferred embodiment(s) of the invention, are intended for purposes of illustration only and are not intended to limit the scope of the invention.

BRIEF DESCRIPTION OF THE DRAWINGS

A preferred embodiment(s) of the invention, illustrative of the best mode in which applicants have contemplated applying the principles, are set forth in the following description and are shown in the drawings, and are more particularly and distinctly pointed out and set forth in the appended claims.

DESCRIPTION OF THE PREFERRED EMBODIMENT

Figure 1:
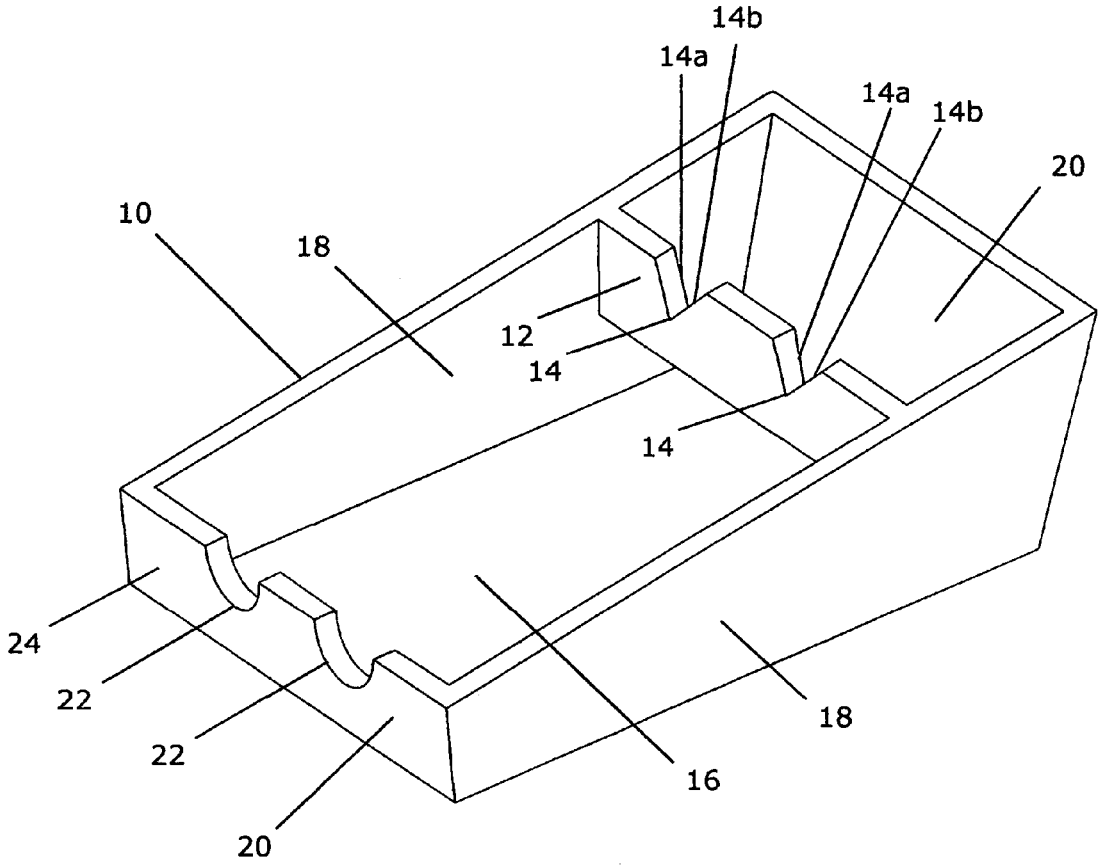
FIG. 1 is a perspective view of an open top incline toothbrush holder wherein the handle of the toothbrush(s) partially extends outside the tray of the toothbrush holder when placed thereon.

The following description of the preferred embodiment(s) is merely exemplary in nature and is in no way intended to limit the invention, its application, or uses. An open top incline toothbrush holder, generally noted as 10, is indicated generally in FIG. 1. The open top incline toothbrush holder 10 comprises a brace or transverse member 12, with first notches or slots or indents 14 therein, mounted or constructed in a toothbrush holder base or tray 16 with walls 18, 20, to hold the head(s) of toothbrush(s) (not shown) in an incline, higher position, and which has second notches or slots or indents 22 in the foot 24 or lower part of the toothbrush holder tray 16, which second notches or slots or indents 22 hold the handle(s) of the toothbrush(s) (not shown) in the declined, lower position. Said first notches, slots or indents 14 in said internal brace or transverse member 12 are of various shapes and sizes including, without limitation, the following shapes: V-shaped or other shaped notches and V-shaped, flat, curved, oval, rounded or other shaped slots or indents. The sidewalls 18, 20 of the toothbrush holder tray 16 are either slanted or vertical or any combination thereof. Said second notches, slots or indents 22 in the foot or lower part 24 of the toothbrush holder tray 16 are of various shapes and sizes including, without limitation, the following shapes: V-shaped or other shaped notches and V-shaped, flat, curved, oval, rounded or other shaped slots or indents.

The neck or stem of the head of the toothbrush(s) is placed or laid in the first notch or slot or indent 14 of the internal brace or transverse member 12 and the handle of the toothbrush(s) is placed or laid in the second notch or slot or indent 22 on the foot or lower part 24 of the toothbrush holder tray 16, with said toothbrush holder thereby holding each toothbrush in an incline position with a portion of the handle of the toothbrush(s) extending outside the tray 16.

The toothbrush holder 10 can be created, constructed or formed of variety of materials, including, but not limited to, plastic, metal, and water-resistant fibrous materials, using production methods known in the art. The component parts of the toothbrush holder 10 can, for example, be assembled using adhesive, adhesive tape, screws, or other fasteners, welding techniques or methods, or other production methods known in the art, or the toothbrush holder can be created, constructed or formed in a one piece unit, or in part, by injection molding of plastic or polymer or by other production methods known in the art.

While any combination of notches, including but not limited to V-shaped or other notches, or slots or indents, including but not limited to V-shaped, flat, curved, oval, rounded or other slots or indents, may be used in the internal brace or transverse member of the toothbrush holder and the foot of the toothbrush holder, and thus fall within the scope of this invention, use of V-shaped notches 14 on the internal brace or transverse member 12 of said toothbrush holder 10 in combination with a flat, curved, oval, rounded, or other slot or indent 22 on the foot 24 on said toothbrush holder 10 holds toothbrushes placed on said toothbrush holder in an especially stable manner since the V-shaped notch 14 in the internal brace or transverse member 12 provides two contact points 14*a*, 14*b* on and against the neck of the toothbrush which, in combination with the contact of the handle of the toothbrush against the slot or indent 22 on the foot 24 of the toothbrush holder, holds toothbrushes in said toothbrush holder in a stable manner. No known prior art uses such V-shaped notches 14 to hold a toothbrush in an incline or horizontal position on a toothbrush holder.

In the preferred embodiment, the handle of the toothbrush (s) partially extends outside the tray of the toothbrush holder 10, and the toothbrush holder itself thereby occupies less space in the drawer.

Figure 2:
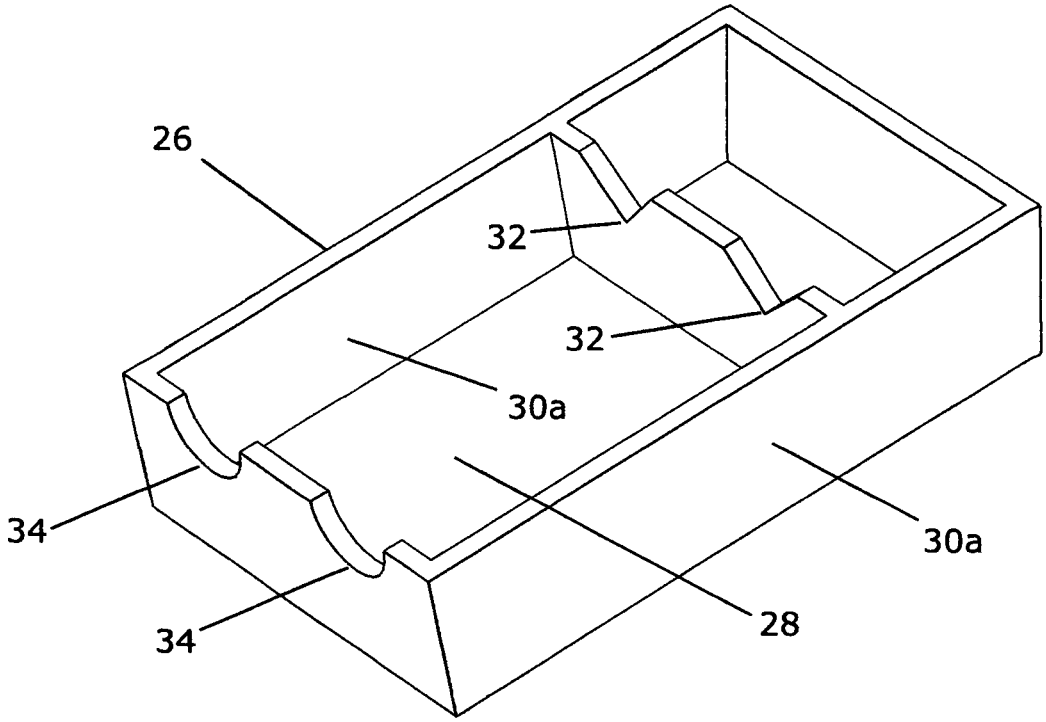
FIG. 2 is a perspective view of an open top horizontal toothbrush holder wherein the handle of the toothbrush(s) partially extends outside the tray of the toothbrush holder when placed thereon.
Figure 3:
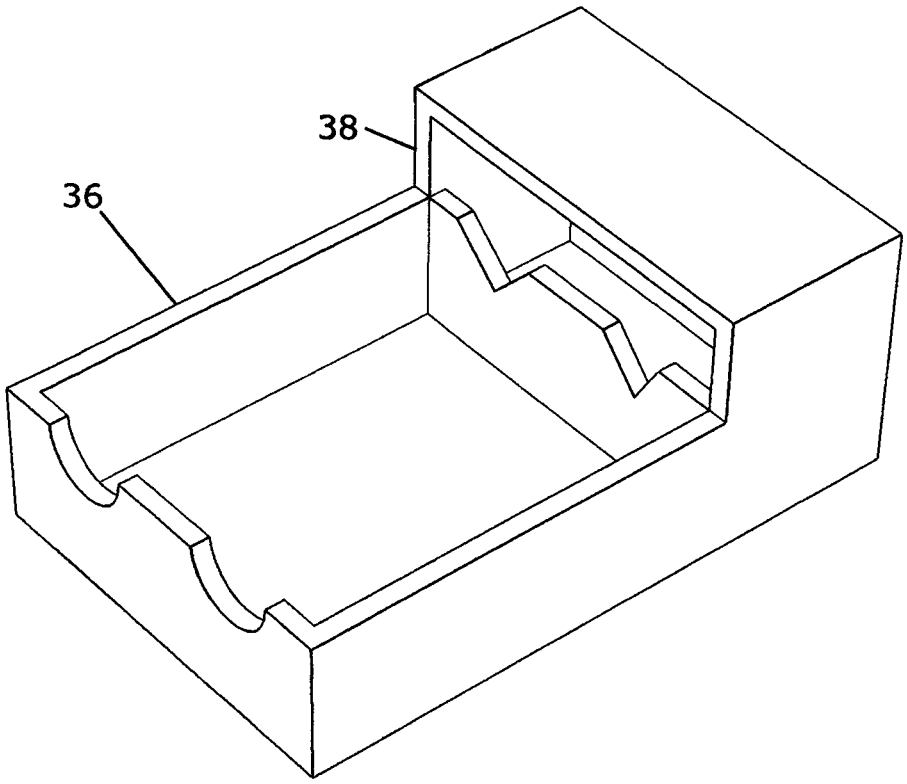
FIG. 3 is a perspective view of the open top horizontal toothbrush holder shown in FIG. 2 but with a hood over the area of the toothbrush holder where the head of the toothbrush (s) would be positioned when placed on said holder.
Figure 4:
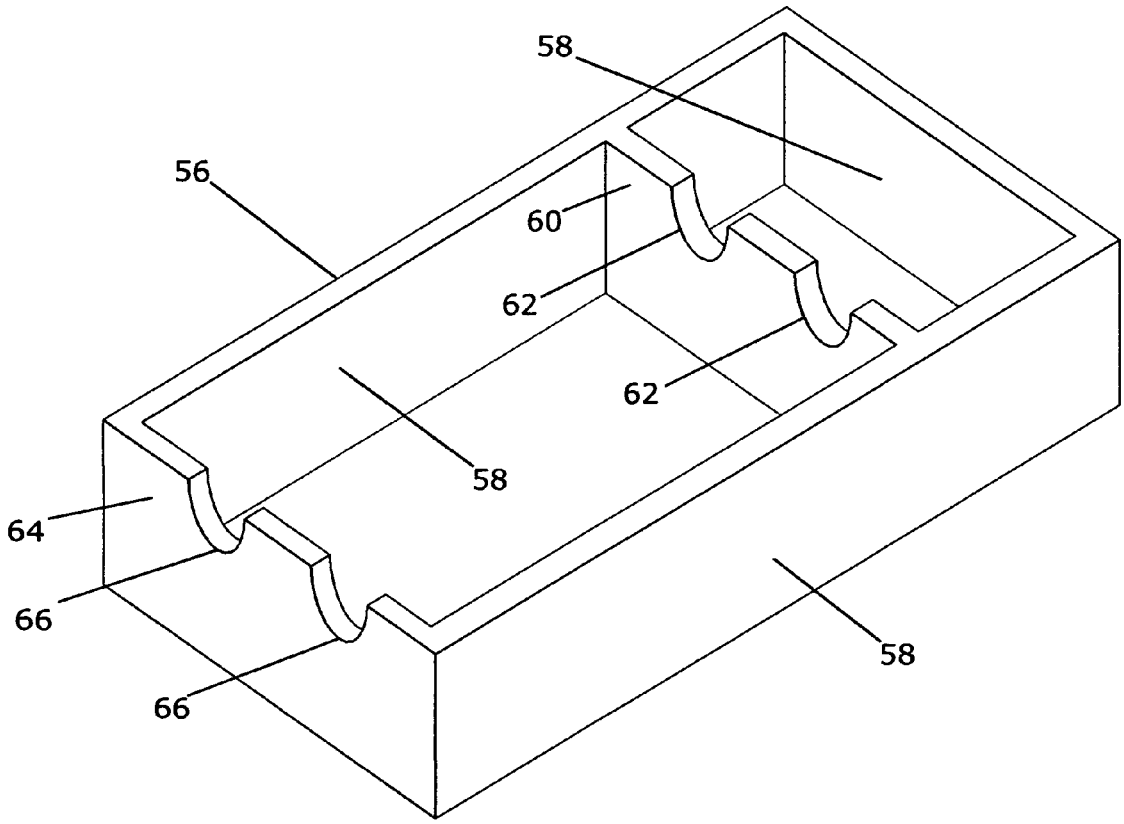
FIG. 4 is a perspective view of an open top horizontal toothbrush holder with first and second transverse support members that include curvilinear indents and wherein the second transverse support member forms a wall at one end of the base of said holder such that the handle of the toothbrush (s) partially extends outside the tray of the toothbrush holder when placed thereon.
Figure 5:
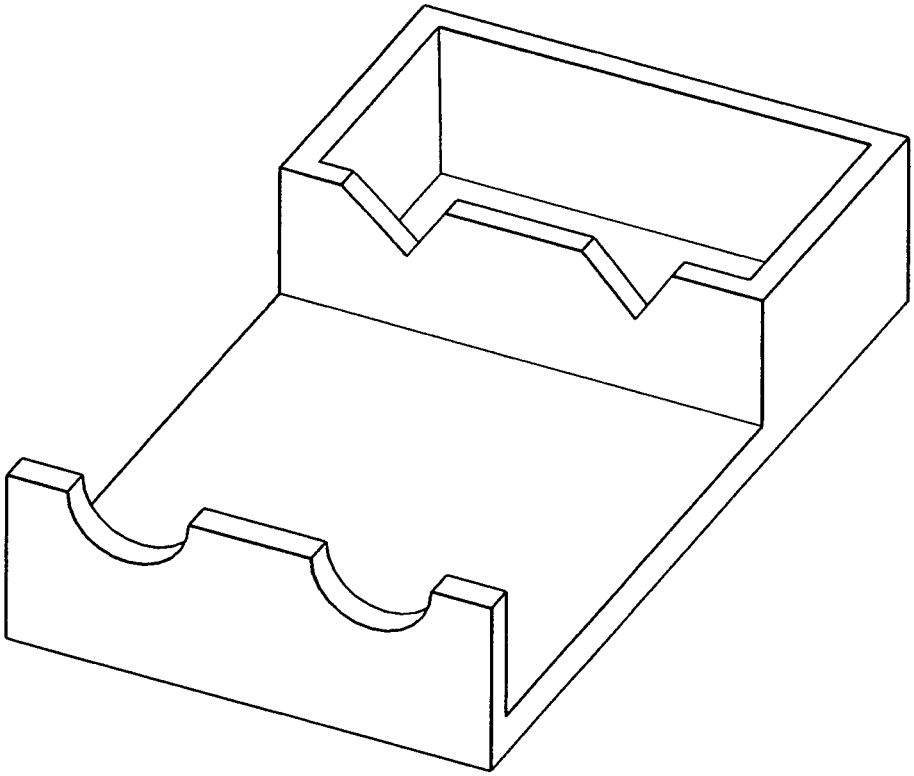
FIG. 5 is a perspective view of an open top horizontal toothbrush holder with a reservoir only in the area of the toothbrush holder wherein the head of the toothbrush(s) would be positioned when placed on said holder with a support member that supports the neck of the toothbrush constructed as a wall of the reservoir, and with a support member at the end of the base of the holder spaced apart the reservoir such that the handle of the toothbrush(s) partially extends outside the base of the toothbrush holder when placed thereon.
Figure 6:
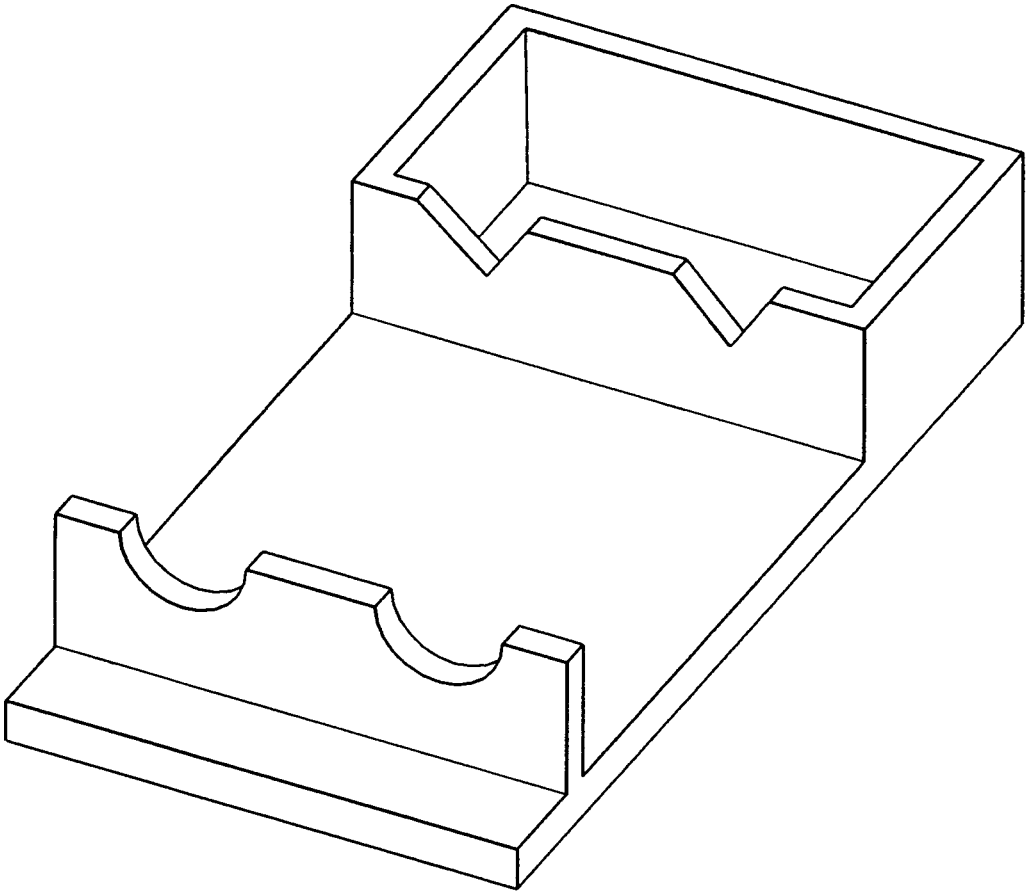
FIG. 6 is a perspective view of the open top horizontal toothbrush holder shown in FIG. 5 but with an extended base.
Figure 7:
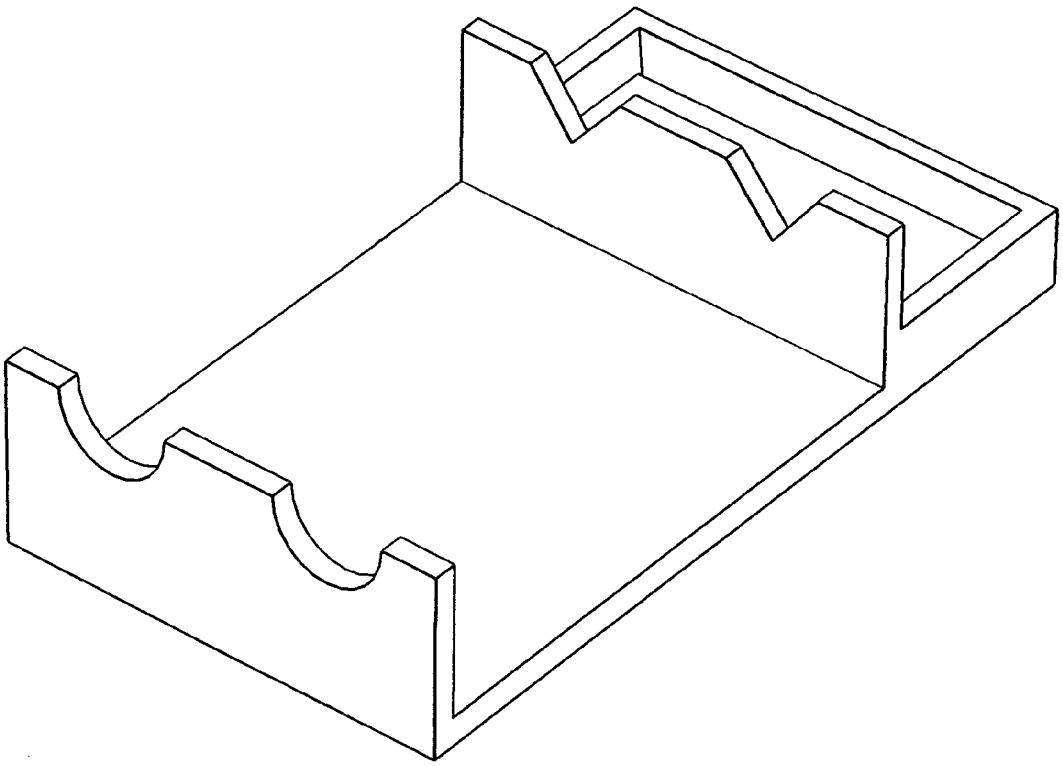
FIG. 7 is a perspective view of the open top horizontal toothbrush holder shown in FIG. 5 but with a reservoir with reduced wall height in the walls of the reservoir exterior to the toothbrush holder.
Figure 8:
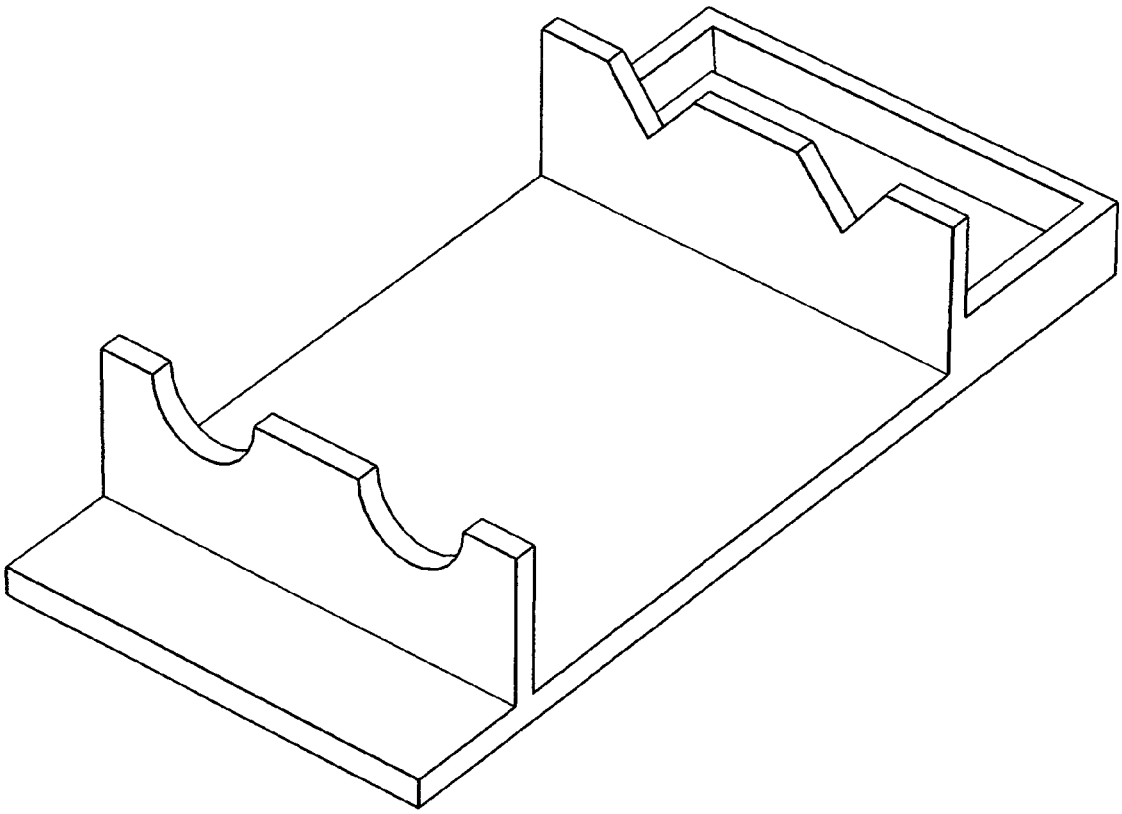
FIG. 8 is a perspective view of the open top horizontal toothbrush holder shown in FIG. 7 but with an extended base.
Figure 9:
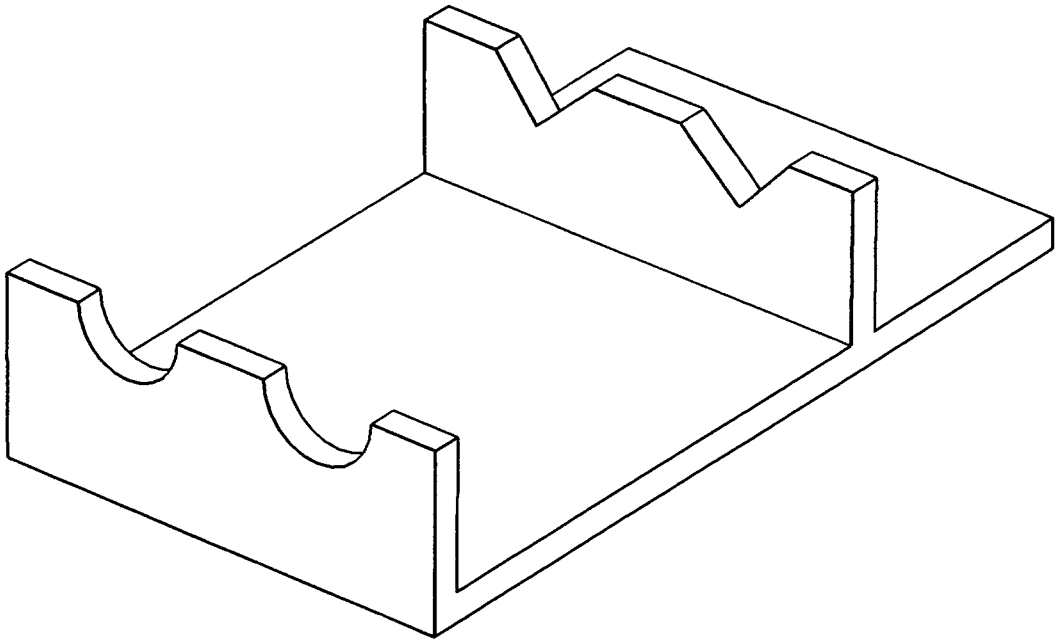
FIG. 9 is a perspective view of the open top horizontal toothbrush holder shown in FIG. 5 but without a reservoir.
Figure 10:
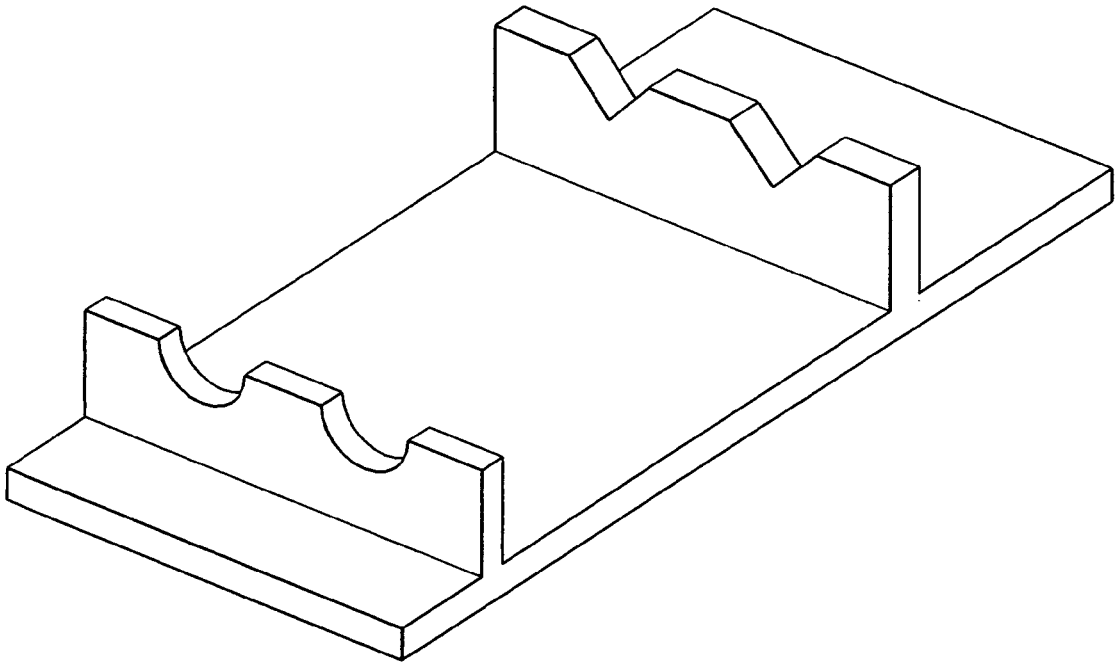
FIG. 10 is a perspective view of the toothbrush holder shown in FIG. 9 but with an extended base.

Additional embodiments of the invention which are also merely exemplary in nature and which are in no way intended to limit the invention, its application, or uses are indicated generally in FIG. 2, FIG. 3, and FIG. 4.

The exemplary embodiment shown in FIG. 2 shows an open top horizontal toothbrush holder 26 wherein the handle of the toothbrush(s) partially extends outside the base or tray 28 of the toothbrush holder when placed thereon. However, the use of non-inclined sidewalls 30*a* provide the modification such that the holding each toothbrush in a horizontal position is accomplished by the appropriate dimensioning of the V-shaped notches 32 and rounded indents 34, respectively.

The exemplary embodiment shown in FIG. 3 shows an open top horizontal toothbrush holder 36 as shown in FIG. 2 but with a hood 38 over the area of the toothbrush holder where the head of the toothbrush(s) would be positioned when placed on the holder 36.

The exemplary embodiment shown in FIG. 4 shows an open top horizontal toothbrush holder 56 with walls 58 with a first transverse support member 60 that includes curvilinear indents 62 and a second transverse support member 64 that includes curvilinear indents 66, wherein the holder is configured such that the second transverse support member 64 forms a wall at one end of the base of said holder such that the handle of the toothbrush(s) partially extends beyond said wall when placed on said holder.

Additional embodiments are also anticipated in which the teachings, features and benefits can be achieved, but the design or configuration of the base or tray element modified to provide either a different aesthetic, or additional features in combination. Several such variations are also shown in FIG. 5, FIG. 6, FIG. 7, FIG. 8, FIG. 9, and FIG. 10 but which are also merely exemplary in nature and which are in no way intended to limit the invention.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

While particular embodiments of the present invention have been shown and described, it will be obvious to those skilled in the art that changes and modifications may be made without departing from the invention in its broader aspects and, therefore, the aims of its appended claims are to cover all such changes and modifications as fall within the true spirit and scope of this invention. As various changes could be made in the above construction without departing from the scope of the invention, it is intended that all matter contained in the above description or shown in the accompanying drawings shall be interpreted as illustrative and not in a limiting sense. Although the description above contains many specificities, these should not be construed as limiting the scope of the invention but as merely providing illustrations of some of the presently preferred embodiments of this invention. Accordingly, the present invention is not limited to the specific embodiment(s) shown in the drawings and described in detail hereinabove. For example, and without in any way limiting the scope of the claims appended hereto, some or all of, or any combination of, the edges and corners of the toothbrush holders shown in the drawings and described hereinabove can be rounded, thereby imparting different aesthetics to the toothbrush holder, which changes and modifications fall within the true spirit and scope of the invention. As an additional example, and without in any way limiting the scope of the claims appended hereto, the internal transverse member that supports the neck of the head of the toothbrush, and the internal transverse member that supports the handle of the toothbrush, can be constructed as a wall directly connected to the bottom of the tray of the toothbrush holder or as a transverse member that is not directly connected to the bottom of the tray of the toothbrush holder. As an additional example, and without in any limiting the scope of the claims appended hereto, the sidewalls of the toothbrush holder may be either slanted or vertical or any combination thereof. As an additional example, and without in any limiting the scope of the claims appended hereto, the indents, slots or notches in the first and second spaced apart support members, including, without limitation, first and second spaced apart transverse support members, of open top incline toothbrush holders may be of various shapes and sizes and any combination of shapes and sizes, including, without limitation, any combination of the following shapes: V-shaped or other shaped notches and V-shaped, flat, curved, oval, rounded or other shaped slots or indents. As an additional example, and without in any way limiting the scope of the claims appended hereto, the indents, slots or notches in the first and second spaced apart support members, including, without limitation, first and second spaced apart transverse support members, of open top horizontal toothbrush holders wherein the second support member or second transverse support member is attached proximate one end of the base of the toothbrush holder such that the handle of the toothbrush partially extends beyond the base of the holder when placed thereon, may be of various shapes and sizes and any combination of shapes and sizes, including, without limitation, any combination of the following shapes: V-shaped or other shaped notches and V-shaped, flat, curved, oval, rounded or other shaped slots or indents. As an additional example, and without in any way limiting the scope of the claims appended hereto, holders may be constructed with or without sidewalls.

The invention, including without limitation the exemplary embodiments described herein, thus achieves the enumerated objectives including without limitation: (a) to provide a toothbrush holder that will hold one or more toothbrushes in an incline, or in the alternate a horizontal, position instead of the vertical position to enable the toothbrush holder to be placed in a closed typical drawer in a bathroom; (b) to provide an open top toothbrush holder that will allow one or more toothbrushes to be held in an incline, or in the alternate a horizontal, position in a closed typical drawer in a bathroom, to allow liquid to drain off and/or evaporate from the toothbrush(s) while laying on the toothbrush holder inside the closed drawer, and, by virtue of having been placed in a closed drawer, to help shield the toothbrush(s) resting on the toothbrush holder from bacteria that are released into the air in the bathroom when the toilet in the bathroom is flushed; (c) to provide an incline, or in the alternate a horizontal, toothbrush holder that, except for embodiments like the embodiments shown in FIG. 9 and FIG. 10 has a reservoir or receptacle to catch liquids that drop from the head of the toothbrush that is placed in it; (d) to provide an incline, or in the alternate a horizontal, toothbrush holder that provides stable support for both the neck and the handle of toothbrushes placed on it and on which a toothbrush can be quickly, easily, and conveniently placed; (e) to provide an incline, or in the alternate a horizontal, toothbrush holder to hold the head of the toothbrush(s) placed thereon in a raised position such that the head of the toothbrush does not come into contaminating contact with the body of the toothbrush holder; (f) to provide an incline, or in the alternate a horizontal, toothbrush holder that provides the convenience of: (i) being able to conveniently store the toothbrush holder in a typical drawer in a bathroom with convenient, quick, and easy access to the open top incline, or in the alternate a open top horizontal, toothbrush holder and the brush(s) resting thereon by simply opening said drawer, and (ii) being able to place the toothbrush(s) on, and remove the toothbrush(s) from, the incline, or in the alternative a horizontal, toothbrush holder stored in said drawer without having to open or remove a cover or lid on the toothbrush holder; (g) to provide a toothbrush holder that is easy to clean; and (h) to provide a toothbrush holder that is easy to manufacture. The invention thus provides, without limitation, the advantages discussed herein over the prior art.

What is claimed is:

1. A holder for one or more toothbrushes used to clean the surface of teeth, said toothbrushes having a body that has a neck that extends between a cleaning head and an elongated handle, said head having a dimension preventing it from being placed between the teeth, the holder comprising:

a base; and first and second spaced apart support members supported by said base, wherein said first support member includes a first indent, and said second support member includes a second indent, said indents aligned and vertically offset from one another, such that said first indent is comprised of two oblique rectilinear support surfaces, wherein said rectilinear support surfaces are adapted to support the neck of the toothbrush, and said second indent is adapted to support the handle, wherein said support members and indents are configured so as to support the toothbrush in an inclined orientation on the holder with the bottom of said first indent located at a larger distance from the base of the holder than the bottom of said second indent, wherein the holder is configured such that the first support member is attached such that the cleaning head of the toothbrush does not extend beyond the perimeter of the holder when placed thereon, and wherein the holder is configured such that the second support member is attached proximate one end of said base such that the handle of the toothbrush partially extends beyond said base of the holder when placed thereon, the holder further comprising:

a pair of walls attached to said base, wherein said first and second support members transversely extend between said walls.

2. The holder of claim 1, wherein at least one of said walls is slanted.

3. The holder of claim 1, wherein said second support member forms a wall at one end of said base.

4. A holder for one or more toothbrushes used to clean the surface of teeth, said toothbrushes having a body that has a neck that extends between a cleaning head and an elongated handle, said head having a dimension preventing it from being placed between the teeth, the holder comprising:

a base; and first and second spaced apart support members supported by said base, wherein said first support member includes a first indent, and said second support member includes a second indent, said indents aligned and vertically offset from one another, wherein said first indent is adapted to support the neck of the toothbrush, and said second indent is adapted to support the handle, wherein said support members and indents are configured so as to support the toothbrush in an inclined orientation on the holder with the bottom of said first indent located at a larger distance from the base of the holder than the bottom of said second indent, wherein the holder is configured such that the first support member is attached such that the cleaning head of the toothbrush does not extend beyond the perimeter of the holder when placed thereon, and wherein the holder is configured such that the second support member is attached proximate one end of said base such that the handle of the toothbrush partially extends beyond said base of the holder when placed thereon, the holder further comprising:

a pair of walls attached to said base, wherein said first and second support members transversely extend between said walls.

5. The holder of claim 4, wherein at least one of said walls is slanted.

6. The holder of claim 4, wherein said second support member forms a wall at one end of said base.

7. A holder for one or more toothbrushes used to clean the surface of teeth, said toothbrushes having a body that has a neck that extends between a cleaning head and an elongated handle, said head having a dimension preventing it from being placed between the teeth, the holder comprising:

a base; and first and second spaced apart support members supported by said base, wherein said first support member includes a first indent, and said second support member includes a second indent, said indents substantially horizontally aligned with one another, such that said first indent is comprised of two oblique rectilinear support surfaces, wherein said rectilinear support surfaces are adapted to support the neck of the toothbrush, and said second indent is adapted to support the handle, wherein said support members and indents are configured so as to support the toothbrush in a substantially horizontal orientation on the holder, wherein the holder is configured such that the first support member is attached such that the cleaning head of the toothbrush does not extend beyond the perimeter of the holder when placed thereon, wherein the holder is configured such that the second support member is attached proximate one end of said base such that the handle of the toothbrush partially extends beyond said base of the holder when placed thereon, wherein the holder is configured such that said end of the base of the holder is the only end of the base of the holder beyond which the handle of a toothbrush is capable of extending when placed thereon, and wherein the holder is configured to hold the cleaning head of the toothbrush in a raised position such that the bristles of the cleaning head do not come into contact with said base of the holder when the bristles of the cleaning head are facing toward said base of the holder, the holder further comprising:

a pair of walls attached to said base, wherein said first and second support members transversely extend between said walls.

8. The holder of claim 7, wherein at least one of said walls is slanted.

9. The holder of claim 7, wherein said second support member forms a wall at one end of said base.

10. A holder for one or more toothbrushes used to clean the surface of teeth, said toothbrushes having a body that has a neck that extends between a cleaning head and an elongated handle, said head having a dimension preventing it from being placed between the teeth, the holder comprising:

a base; and first and second spaced apart support members supported by said base, wherein said first support member includes a first indent adapted to support the neck of the toothbrush, and said second support member includes a second indent adapted to support the handle of the toothbrush, said indents substantially horizontally aligned with one another, wherein said support members and indents are configured so as to support the toothbrush in a substantially horizontal orientation on the holder, wherein the holder is configured such that the first support member is attached such that the cleaning head of the toothbrush does not extend beyond the perimeter of the holder when placed thereon, wherein the holder is configured such that the second support member is attached proximate one end of said base such that the handle of the toothbrush partially extends beyond said base of the holder when placed thereon, wherein the holder is configured such that said end of the base of the holder is the only end of the base of the holder beyond which the handle of a toothbrush is capable of extending when placed thereon, and wherein the holder is configured to hold the cleaning head of the toothbrush in a raised position such that the bristles of the cleaning head do not come into contact with said base of the holder when the bristles of the cleaning head are facing toward said base of the holder, the holder further comprising:

a pair of walls attached to said base, wherein said first and second support members transversely extend between said walls and wherein said second support member forms a wall at one end of said base.

11. The holder of claim 10, wherein at least one of said walls is slanted.

12. A holder for one or more toothbrushes used to clean the surface of teeth, said toothbrushes having a body that has a neck that extends between a cleaning head and an elongated handle, said head having a dimension preventing it from being placed between the teeth, the holder comprising:

a base; and first and second spaced apart support members supported by said base, wherein said first support member includes a first indent, and said second support member includes a second indent, said indents aligned and vertically offset from one another, such that said first indent is comprised of two oblique rectilinear support surfaces, wherein said rectilinear support surfaces are adapted to support the neck of the toothbrush, and said second indent is adapted to support the handle, wherein said support members and indents are configured so as to support the toothbrush in an inclined orientation on the holder, wherein the holder is configured such that the first support member is attached such that the cleaning head of the toothbrush does not extend beyond the perimeter of the holder when placed thereon, and wherein the holder is configured such that the second support member is attached proximate one end of said base such that the handle of the toothbrush partially extends beyond said base of the holder when placed thereon, the holder further comprising:

a pair of walls attached to said base, wherein said first and second support members transversely extend between said walls.

13. The holder of claim 12, wherein at least one of said walls is slanted.

14. The holder of claim 12, wherein said second support member forms a wall at one end of said base.

15. A holder for one or more toothbrushes used to clean the surface of teeth, said toothbrushes having a body that has a neck that extends between a cleaning head and an elongated handle, said head having a dimension preventing it from being placed between the teeth, the holder comprising:

a base; and first and second spaced apart support members supported by said base, wherein said first support member includes a first indent, and said second support member includes a second indent, said indents substantially horizontally aligned with one another, such that said first indent is comprised of two oblique rectilinear support surfaces, wherein said rectilinear support surfaces are adapted to support the neck of the toothbrush, and said second indent is adapted to support the handle, wherein said support members and indents are configured so as to support the toothbrush in a substantially horizontal orientation on the holder, wherein the holder is configured such that the first support member is attached such that the cleaning head of the toothbrush does not extend beyond the perimeter of the holder when placed thereon, wherein the holder is configured such that the second support member is attached proximate one end of said base such that the handle of the toothbrush partially extends beyond said base of the holder when placed thereon, and wherein the holder is configured such that said end of the base of the holder is the only end of the base of the holder beyond which the handle of a toothbrush is capable of extending when placed thereon, the holder further comprising:

a pair of walls attached to said base, wherein said first and second support members transversely extend between said walls.

16. The holder of claim 15, wherein at least one of said walls is slanted.

17. The holder of claim 15, wherein said second support member forms a wall at one end of said base.

* * * * *